United States Patent [19]

Budich

[11] 3,946,524

[45] Mar. 30, 1976

[54] BLIND FRAME AND SASH CONSTRUCTIONS FOR SASH WINDOWS, SLIDING DOORS, AND THE LIKE

[75] Inventor: Wolfgang Budich, Troisdorf-Sieglar, Germany

[73] Assignee: Dynamit Nobel AG, Troisdorf, Germany

[22] Filed: Feb. 25, 1974

[21] Appl. No.: 445,657

[30] Foreign Application Priority Data

Feb. 24, 1973 Germany ..... 2309273

[52] U.S. Cl. ..... 49/442; 49/425; 49/428

[51] Int. Cl.[2] ..... E05D 15/12

[58] Field of Search ..... 49/425, 501, 504, 428, 49/436, 442, 444

[56] References Cited

UNITED STATES PATENTS

| | | | |
|---|---|---|---|
| 2,931,434 | 4/1960 | Steel | 49/425 X |
| 3,106,754 | 10/1963 | Grossman | 49/425 X |
| 3,136,396 | 6/1964 | Sullivan | 49/425 |
| 3,217,454 | 11/1965 | Leisibach | 49/425 X |
| 3,583,101 | 6/1971 | Pudenz | 49/425 X |

*Primary Examiner*—Kenneth Downey
*Attorney, Agent, or Firm*—Craig & Antonelli

[57] ABSTRACT

An arrangement of profile members for sash windows, sliding doors and the like which includes interconnected blind frame profile members of similar cross-section along the length thereof connected to one another to form a blind frame. Sash frames are also formed by constant cross-section sash frame profile members interconnected to one another. To accommodate a simple attachment and detachment of a sash frame to a blind frame, a V-shaped elastic mounting profile element is provided which snap-fittingly attaches to the blind frame and guidingly accommodates the sash frame. This elastic profile mounting element is provided along three sides of the frame construction with the other side including a T-shaped aluminum guide rail for accommodating sash rollers or the like. For attaching the glazing to the sash profile members, an acute angled elastic profile element with legs of unequal length is provided, which is stressed so as to elastically clamp the glazing against the sash profile member when in the installed condition. A grip molding profile element is also provided which clampingly engages the sash profile member and also serves to accommodate reinforcing irons and the like.

26 Claims, 4 Drawing Figures

BLIND FRAME AND SASH CONSTRUCTIONS FOR SASH WINDOWS, SLIDING DOORS, AND THE LIKE

BACKGROUND AND SUMMARY OF THE INVENTION

The present invention relates to a sash window blind frame and sash constructions for sash windows, sliding doors, and the like made of profile members preferably of a synthetic resin. Although the following description refers to sash windows, it is to be understood that the present invention also contemplates sliding doors, etc., constructions having a blind frame and sash. Preferred embodiments of the present invention are particularly related to sash windows of the type wherein profile members having respective identical cross sections are utilized for all frame sides of the blind frame and sash. Preferred contemplated sash window constructions of the present invention also include provisions for metallic profile members inserted in the synthetic resin profile member and/or slide in corners (angles).

A number of profile members for the production of sash windows, sliding doors, or the like have been contemplated which start with respectively identical profile members for all sides of a blind frame or sash. The blind frames are formed in each case in pairs with fixed projections to guide the sash and form a running surface or track for the rollers. The cross sections of such profiles are fashioned so that they withstand high and maximum stresses. This is true not only for the construction of the blind frame, but also the sash, the cross section of which is selected to be so large that it can, for example, also accommodate double glazings (windows).

The present invention contemplates providing a sash window and/or sliding door construction made up of profile members, which window is distinguished over previously contemplated profile structures not only by a low weight of the profile members, thus being suitable especially for smaller units, but also by a simple manufacture and economical assembly.

The present invention further contemplates producing the connection of blind frame and sash along three sides by means of a resiliently constructed mounting profile snapped into an undercut groove at the blind frame profile member with a projecting, approximately V-shaped central section of this mounting profile being guided between projections of the sash profile member.

In contrast to the heretofore customary rigid guides of the blind frame for the sash, the present invention provides a resilient, elastic guide so that the sash profile member can be easily hung and/or detached into and from the blind frame, which is possible by the snap connection due to the resiliency of the inserted mounting profile. The present invention also contemplates arrangements with the mounting profile glued (cemented) to the blind frame. Due to the resiliency of the mounting profile, the sash profile member can accordingly be dimensioned in its size and inserted with only a minor clearance with respect to the blind frame profile member. The resilient, elastic mounting profile is preferably extruded, for example, of a thermoplastic synthetic resin, e.g., PVC.

In a further development of this invention, the blind frame is formed with two continuous undercut grooves arranged side-by-side, preferably in a dovetail shape for accommodating a T-shaped track (guide) rail. This T-shaped track rail is preferably of metal such as aluminum. The blind frame profile member is furthermore formed, in an extension of one side of the profile, with a blind (facing) fillet projecting beyond the grooves.

The present invention further contemplates providing a particularly simple way of mounting the glazing in the sash profile member, wherein a groove of the sash profile member, formed beyond the horizontally extending glazing flange serving as the contact surface for a glazing (glass is it utilized to receive a fastening means for the glazing. As the fastening means, a novel, acute-angled profile element is provided, with legs of unequal lengths and made of an elastic material, e.g., chloroprene. With its short leg, this acute-angled profile element engages into the groove of the sash profile member and, with its long leg, the element rests on the glazing. In preferred embodiments this long leg is equipped with additional sealing lips. In order to affix the fastening means to the sash profile, the fastening (acute-angled) profile element is profiled with lugs and/or recesses which engage corresponding and/or projections at the sash profile member. By a simple pressing of this acute-angled fastening profile element along the continuous groove at the sash, so that it engages the groove, the glazing is mounted with one manipulation, any unevennesses or the like being compensated for by the elastic profile. In preferred embodiments, a further groove on the other side of the glazing flange of the sash profile member is provided which serves to receive a sealing profile for the glazing on the side contacting the sash profile member.

The present invention further contemplates a novel construction of a grip molding (handle rail) to handle a sash on a window or sliding door. According to the invention, an angular profile element having a closed leg and an open leg and forming a grip molding is clamped to the projections of the sash profile member. The open leg of the grip molding is formed by two sides of unequal lengths, wherein the inner, shorter side engages, hook-like, the groove formed on the inside of the projection of the sash, and the outer projecting side contacts the sash profile member on the outside and, with a mounting extension, the end of the projection of the sash profile member. This construction of the grip molding makes it possible to effect a resilient suspension at the sash. A reinforcing iron in flat or angular construction can be inserted in the hollow grip molding in accordance with preferred embodiments where the additional reinforcement is desired or required. The grip molding is preferably also constructed so that it can receive gaskets. For receiving gaskets, the projecting side (longer side) of the grip molding is formed with a groove on the side facing away from the sash profile member. The grip molding is preferably fashioned as an extruded profile element, for example of PVC.

A sash window constructed with the above-mentioned novel features is distinguished by the cooperation of the individual components which are advantageously constructed with functional efficiency and which result, in their entirety, in a readily manipulatable (operable) sash window economical in its manufacture and work-saving in its installation. This sash window can be equipped with simple glazing and also with commercial fittings. The window can also be utilized in case of higher mechanical stresses by the insertion of reinforcing profile elements of metal into the hollow blind frames or sashes.

These and further objects, features and advantages of the present invention will become more obvious from the following description when taken in connection with the accompanying drawings which show, for purposes of illustration only, a single embodiment in accordance with the present invention.

Figure 1:
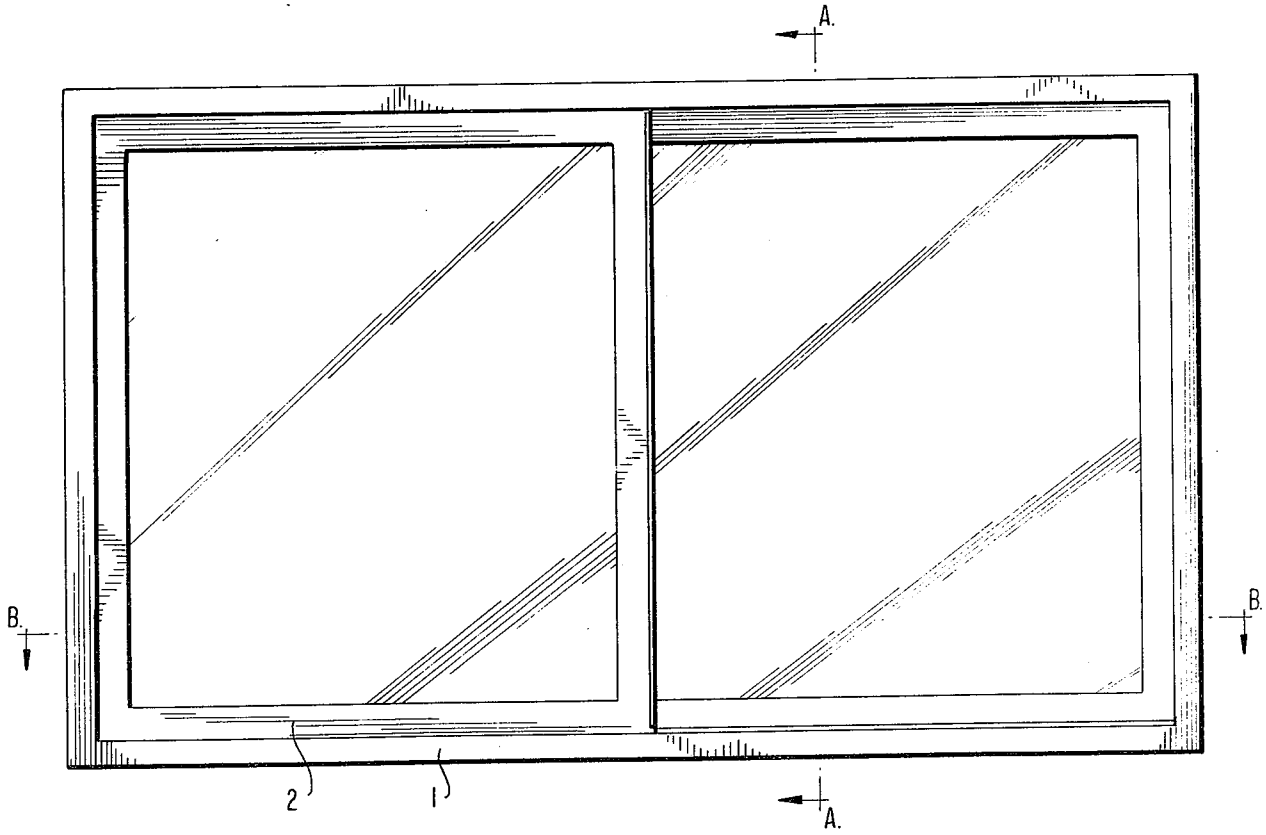
FIG. 1, is a side view which shows a closed horizontal sash window constructed in accordance with the present invention.

The invention is explained with reference to the horizontal sash window according to FIG. 1; however, the invention is likewise applicable to vertical sash windows as well. The blind frame 1 and the sash 2 are composed of profile members of, preferably, a thermoplastic synthetic resin produced by the extrusion molding method. The structure of these profile members can be seen in detail from the sectional views shown in FIGS. 2 and 4.

Figure 2:
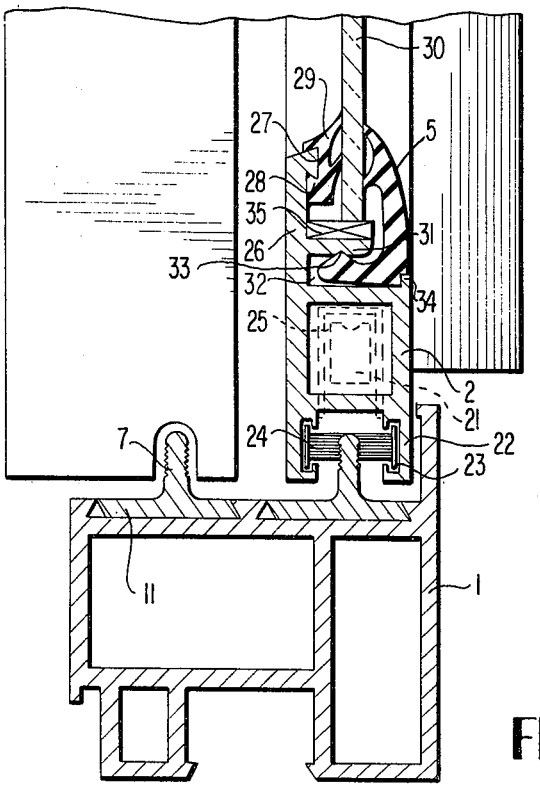
FIG. 2 is a vertical sectional view along line A—A of FIG. 1.

The vertical sectional view of FIG. 2 shows the guidance of the sash in the blind frame. The blind frame is constructed from the blind frame profile members 1, produced as a multiple-chamber, extruded hollow profile of a synthetic resin. The configuration of the blind frame profile member 1 is such that anchoring projections are provided on the side facing the masonry in order to anchor the blind frame therein. Commonly assigned copending U.S. patent application Ser. No. 285,113, filed Aug. 31, 1972 discloses details of blind frame anchoring projections that could be used in conjunction with the present invention. To the extent necessary for a full understanding of the present invention the disclosure of said copending application is hereby incorporated by reference herein. The side of the blind frame profile member 1 opposite the anchoring projections is formed with two undercut grooves 11 which are arranged side-by-side and have a dovetail configuration.

T-shaped guide rails 7 of aluminum are inserted in these grooves 11 to form the track for the sash, corresponding profiled rollers 25 attached to the sash profile member 2, travel on these guide rails. The blind frame profile member 1 is furthermore formed, along one profile side in an extension thereof, as a blind fillet 12 projecting beyond the grooves 11.

The sash is guided along the remaining three sides of the sash window by means of an elastic mounting profile 6 snapped into the grooves 11 of the blind frame profile member 1. The resiliently constructed and elastic mounting profile 6 has an approximately V-shape in the central zone and is provided with horizontal tongues 63 to engage in the groove 11. These tongues 63 are adapted in their end zones to the dovetail-shaped configuration of the grooves 11. One end of each tongue 63 continues in the manner of a U-shaped arc in a further tongue 62, which tongue 62 has a thickened section 64 at its end and which also serves as an auxiliary guide means for the sash profile member 2. To insert into the groove 11, the mounting profile 6 is compressed (angle of the V is decreased) in its central V-shaped zone and is simply inserted by a snap connection. The V-shaped central zone 61 serves as a guide means for the sash profile member 2 which, with an open groove formed by the projections 22, wherein brush (whisker) seals 24 are inserted in additional lateral grooves 23, contacts this zone 61, seals the latter, and is guided therealong. Due to the elasticity of the mounting profile 6, an especially easy installation and detachment of the sash are likewise made possible, wherein only minor oblique positions of the sash to be removed and/or hung are required.

In other preferred embodiments, the mounting profile 6 is also entirely or partially cemented into the grooves 11 of the blind frame profile member 1.

The mounting of the glazing 30 in the sash is illustrated only in the lower portion of FIG. 2, whereas this mounting is omitted in the upper portion, so that the configuration of the sash profile member 2 in this region can be clearly seen. The horizontally extending glazing flange 31 is formed at the sash profile member 2, so that the open mounting groove 32 is formed between the main chamber of the profile member 2 and the glazing flange 31. The glazing 30 is seated on the glazing flange 31 optionally with the interposition of the wedge 35.

The glazing 30 is fastened by means of the acute-angled elastic fastening profile element 5 which engages the groove 32 of the sash profile member 2 with its short leg and rests against the glazing 30 with its long leg. By the acute-angled form of the profile element 5, a compressive pressure is exerted on the glazing 30 to accomplish final mounting and holding of the glazing.

In order to avoid with certainty a disengagement of the fastening profile element 5 from the groove 32, a lug 52 and a recess 53 are provided at the profile element, which engage a corresponding notch 33 in the glazing flange 31 and a mounting web 34 at the sash profile member 2. The glazing 30 is in contact with the other side of sash profile member 2 under interposition of a gasket (sealing means) 29 which is placed on the projection 27 of the sash profile member 2. The profile member 2 is fashioned in this zone of projection 27 so that an abutment strip 26 is formed along one side with the glazing flange 31 branching off from strip 26 such that two grooves 32 and 28 are formed between the thickened end (projection) 27 of the abutment strip and the main chamber 21. The outer zone of the sash profile member 2 is formed with the two mutually parallel projections 22 forming the groove to receive the guide elements 7, 24. Main chamber 21 of the sash profile member 2 accommodates insertion of rollers, fittings, or the like, numbered 25. Only a portion of roller 25 is illustrated, it being understood that the same will straddle and engage on guide element 7.

Figure 3:
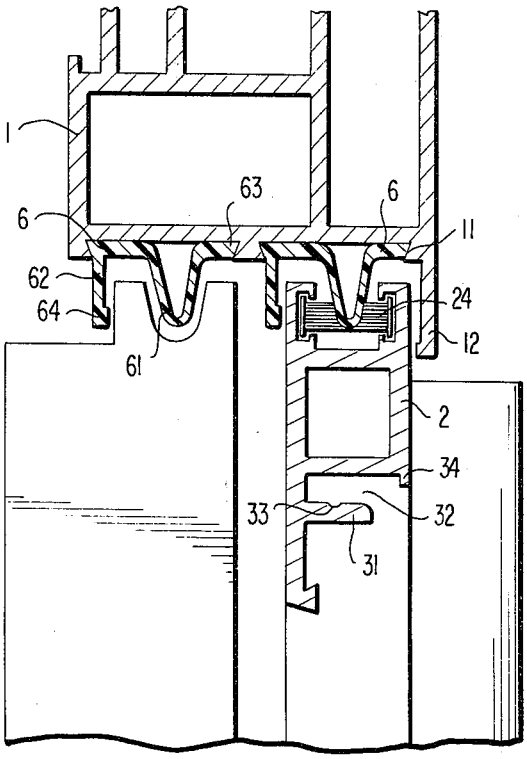
FIG. 3 is an enlarged cross-sectional view through a mounting profile member of FIG. 2.
Figure 3:
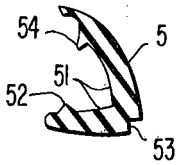

In FIG. 3, the elastic, resilient fastening profile element 5 for the glazing is once again illustrated, in a cross section, so that the details can readily be perceived. The short leg is formed so that it can be mounted in the groove 32 of the sash profile member and comprises the projecting lug 52 and the recess 53 in the outer zone of the acute-angled corner for anchoring of the profile member. This angular profile member 5 is fashioned with the angle 51, which is smaller than 90°, whereby a permanent compressive pressure is exerted on the glazing when the profile member is inserted. With its long leg, the fastening profile member 5 rests on the glazing; additional sealing lips 54 can furthermore be provided.

Figure 4:
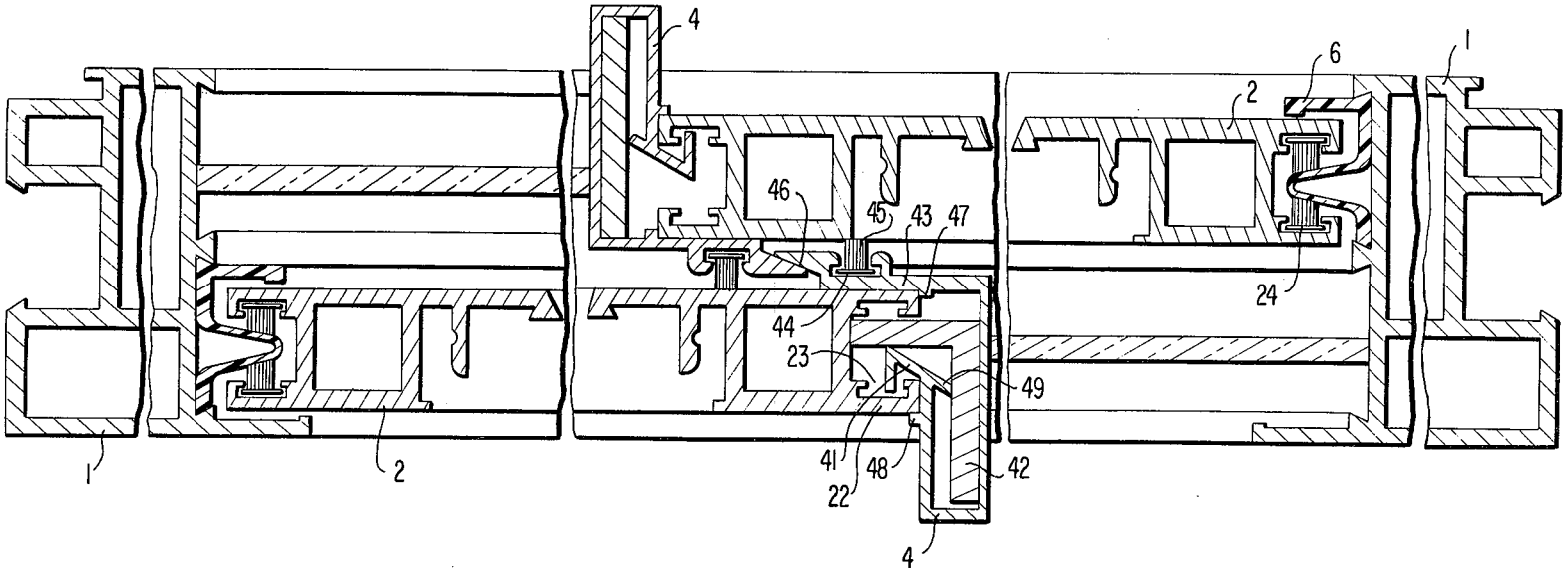
FIG. 4 is a horizontal sectional view along line B—B of FIG. 1.

In the horizontal sectional view according to FIG. 4, showing the sash window, the configuration of the sash profile member 2 with a grip molding 4 is illustrated. This grip molding 4 has such a shape that it can be attached to the end or side of the sash profile member equipped with the projections 22. The basic configuration of the grip molding is an angular profile, one leg of which faces toward the outside wherein the open leg ends have differing lengths. The short, open leg 41 has a hook shape, so that it engages into the groove 23 of the projection 22, which normally would receive a sealing means but for molding 4. In order to affix this short leg to the projection 22, the mounting cam (lug) 48 is provided on the opposite side. Moreover, the short leg 41 is formed toward the inside with an extension web 49 which makes it possible to mount an angle iron 42 or also a flat iron within the grip molding for reinforcing purposes. The long open leg 43, encompassing the second projection 22 of the sash profile member 2 on the outside, has a fixing lug 47 which projects toward the inside. On the side facing away from the sash profile member 2, a groove 44 is provided to receive a sealing means 45. The end 46 of this projecting leg 43 is beveled in a wedge shape. The grip molding 4 serves, on the one hand, for handling the sash and, on the other hand, makes it possible to receive reinforcing irons and seals for the respective sashes.

The sash window of the present invention is distinguished by the use of frame profile members having a relatively simple structure, making it possible to realize a low weight for the profile members and thus an economical manufacture. By the utilization of elastic, resilient connecting parts, a low-noise, tightly sealed, and readily operable window is created.

Although the combination of novel features disclosed herein provide particularly useful preferred embodiments, it is also contemplated by the present invention to utilize individual novel features separate from one another in practicing the invention.

While I have shown and described several embodiments in accordance with the present invention, it is understood that the same is not limited thereto but also contemplates numerous changes and modifications as would be known to those skilled in the art given the present disclosure of the invention, and I therefore do not wish to be limited to the details shown and described herein only schematically, but intend to cover all such changes and modifications.

I claim:

1. An arrangement of profile members for sash windows, sliding doors and the like; said arrangement comprising:

blind frame profile members interconnected to one another to form a blind frame, sash frame profile members interconnected to one another to form a sash frame, and connecting means for connecting said sash frame to said blind frame, said connecting means including a resilient mounting profile member for connecting one side of said blind frame with a corresponding side of said sash frame, wherein said mounting profile member has a cross-section exhibiting a central portion and side portions at opposite sides of said central portion, wherein said side portions are configured for interlocking engagement with locking portions of said blind frame profile member to lock said mounting profile member to said blind frame profile member, wherein said central portion of said mounting profile member is elastically compressible to permit movement of said side portions with respect to one another for accommodating a detachable snap-fit connection of said side portions with said locking portions, wherein said mounting profile member includes guide portions which guidingly support said one side of said sash frame, and wherein said central portion is V-shaped and said side portions are substantially horizontal extensions of the free ends of the legs of the V, wherein said guide portions are formed adjacent the junction of the legs of the V, and wherein said locking portions of said blind frame profile member are undercut groove means.

2. An arrangement according to claim 1, wherein said connecting means includes one each of said resilient mounting profile members for interconnecting each of three sides of said blind and sash frames.

3. An arrangement according to claim 2, wherein each of said blind frame profile members and sash frame profile members have identical cross-sectional configurations for all sides of said respective blind frame and sash frame.

4. An arrangement according to claim 3, wherein said sash frame exhibits projections which extend at opposite lateral sides of said central portion for guiding said sash frame on said mounting profile member.

5. An arrangement according to claim 4, wherein each blind frame profile member is formed with two sets of grooves for accommodating a pair of elastic mounting profile members and associated sash frames.

6. An arrangement according to claim 5, wherein each blind frame profile member has a blind fillet in an extension of one side, which fillet projects in the direction of the adjacent sash profile member beyond the undercut groove means.

7. An arrangement according to claim 2, wherein a T-shaped guide rail is inserted in the undercut groove means of the blind profile member forming the fourth side of said frame, and wherein the sash profile member at said fourth side of the frame is guided at said guide rail.

8. An arrangement according to claim 7, wherein each of said profile members are formed of synthetic resinous material, and wherein said guide rail is formed of aluminum.

9. An arrangement according to claim 1, further comprising glazing fastening means for fastening glazing to said sash frame, wherein each of said sash profile members includes:

a glazing flange extending perpendicular to the plane of glazing to be mounted in said sash frame, and a fastening groove formed peripherally outwardly of said glazing flange with respect to glazing to be mounted in said sash frame, and wherein said glazing flange and fastening groove are configured for holding said glazing fastening means in a glazing holding position on said sash profile member.

10. An arrangement according to claim 9, wherein said glazing fastening means is formed as an elastic acute-angled profile element with legs of unequal lengths with the shorter leg thereof engageable into said fastening groove and the longer leg thereof resiliently biased in clamping engagement with glazing when in an operative position holding glazing to said sash profile member.

11. An arrangement according to claim 10, wherein said acute-angled profiling element is made of chloroprene which includes a plurality of sealing legs at said longer leg which are directly engageable with said glazing.

12. An arrangement according to claim 10, wherein said acute-angled profile element includes at least one of lugs and recesses for fixing engagement with corresponding at least one of recesses and lugs at said sash profile member.

13. An arrangement according to claim 12, wherein said acute-angled profile element includes a recess at the outside corner at the intersection of the legs thereof and a lug at the end of the shorter of the legs for fixing engagement with a corresponding lug and recess on said sash profile member.

14. An arrangement according to claim 9, wherein said sash profile member includes a seal accommodating groove on a side of said glazing flange opposite said fastening groove for accommodating a sealing profile which is engageable with said glazing at a side thereof opposite the side engaged by said glazing fastening means.

15. An arrangement according to claim 10, wherein said sash profile member includes a seal accommodating groove on a side of said glazing flange opposite said fastening groove for accommodating a sealing profile which is engageable with said glazing at a side thereof opposite the side engaged by said glazing fastening means.

16. An arrangement according to claim 1, further comprising a grip molding for manually controlling movement of said sash frame with respect to said blind frame, said grip molding being formed by a grip angle profile member having a closed leg and an open leg, said closed and open legs being clampingly engaged with one of said sash profile members.

17. An arrangement of profile members for sash windows, sliding doors and the like; said arrangement comprising:

blind frame profile members interconnected to one another to form a blind frame, sash frame profile members interconnected to one another to form a sash frame, end connecting means for connecting said sash frame to said blind frame, said connecting means including a resilient mounting profile member for connecting one side of said blind frame with a corresponding side of said sash frame, wherein said mounting profile member has a cross-section exhibiting the central portion and side portions at opposite sides of said central portion, said side portions are configured for interlocking engagement with locking portions of said blind frame profile member to locking said mounting profile member to said blind frame profile member, said central portion is elastically compressible to permit movement of said side portions with respect to one another for accommodating a detachable snap-fit connection of said side portions with said locking portions, said mounting profile member exhibits guide portions which guidingly support said one side of said sash frame, said central portion is V-shaped and said side portions are extensions of the legs of the V, said guide portions are formed adjacent the junction of the legs of the V, said locking portions of said blind frame profile member are undercut grooves, a grip molding for manually controlling movement of said sash frame with respect to said blind frame, said grip molding being formed by a grip angle profile member having a closed leg and an open leg, said closed and open leg being clampingly engaged with one of said sash profile members, and wherein the open leg of the grip profile member is formed with two sides of unequal length, wherein the shorter side hookingly engages an outwardly open groove in said sash profile member, and wherein the longer side contacts the outside of the sash profile member and with a mounting extension contacts an end of a projection forming said outwardly open groove.

18. An arrangement according to claim 17, wherein the longer side includes a seal accommodating groove for accommodating a seal which is engageable with a sash profile member of an adjacent sash frame in a double sash frame construction.

19. An arrangement according to claim 18, wherein a reinforcing iron is supported in said grip profile member in engagement with said sash profile member.

20. An arrangement according to claim 8, further comprising glazing fastening means for fastening glazing to said sash frame, wherein each of said sash profile members includes:

a glazing flange extending perpendicular to the plane of glazing to be mounted in said sash frame, and a fastening groove formed peripherally outwardly of said glazing flange with respect to glazing to be mounted in said sash frame, and wherein said glazing flange and fastening groove are configured for holding said glazing fastening means in a glazing holding position on said sash profile member.

21. An arrangement according to claim 10, further comprising a grip molding for manually controlling movement of said sash frame with respect to said blind frame, said grip molding being formed by a grip angle profile member having a closed leg and an open leg, said closed and open legs being clampingly engaged with one of said sash profile members.

22. An arrangement according to claim 20, further comprising a grip molding for manually controlling movement of said sash frame with respect to said blind frame, said grip molding being formed by a grip angle profile member having a closed leg and an open leg, said closed and open legs being clampingly engaged with one of said sash profile members.

23. An arrangement of profile members for sash windows, sliding doors and the like; said arrangement comprising:

blind frame profile members interconnected to one another to form a blind frame, sash frame profile members interconnected to one another to form a sash frame, connecting means for connecting said sash frame to said blind frame, and grip molding means for manually controlling movement of said sash frame with respect to said blind frame, said grip molding means being formed by at least one grip angle profile member having a closed leg and an open leg, said closed and open legs being clampingly engaged with one of said sash profile members and wherein the open leg of the grip profile member is formed with two sides of unequal length, wherein the shorter side hookingly engages an outwardly open groove in said sash profile member, and wherein the longer side contacts the outside of the sash profile member and with a mounting extension contacts an end of a projection forming said outwardly open groove.

24. An arrangement of profile members for sash windows, sliding doors and the like; said arrangement comprising:

blind frame profile members interconnected to one another to form a blind frame, sash frame profile members interconnected to one another to form a sash frame, and connecting means for connecting said sash frame to said blind frame, said connecting means comprises a resilient mounting profile member having a central portion projecting into and being slidably engaged at said sash frame, wherein said central portion of said mounting profile member is V-shaped with the free ends of the respective legs of the V including substantially horizontally extending side portions, locking portions provided on the free ends of said side portions for engagement with said blind frame to lock said mounting profile member to said blind frame, and wherein one of said side portions includes an auxiliary guide means for guiding said sash frame, said guide means extending along a first side of said sash frame.

25. An arrangement according to claim 24, wherein said sash frame includes brush seal means slidably engaging said central portion therebetween.

26. An arrangement according to claim 24, wherein said blind frame profile members have blind fillets which extend along a side of said sash frame opposite said first side.

* * * * *